US006077398A

United States Patent [19]

Fiscus et al.

[11] Patent Number: 6,077,398

[45] Date of Patent: Jun. 20, 2000

[54] METHOD AND APPARATUS FOR WET WEB MOLDING AND DRYING

[75] Inventors: Mark Wilson Fiscus, Kaukauna; Thomas Garrett Neal, Jr., Appleton, both of Wis.

[73] Assignee: Kimberly-Clark Worldwide, Inc., Neenah, Wis.

[21] Appl. No.: 09/137,062

[22] Filed: Aug. 20, 1998

Related U.S. Application Data

[62] Division of application No. 08/837,501, Apr. 14, 1997, Pat. No. 5,851,353

[60] Provisional application No. 60/035,271, Dec. 18, 1996.

[51] Int. Cl.[7] ..... D21F 5/02

[52] U.S. Cl. ..... 162/361; 162/362

[58] Field of Search ..... 162/113, 109, 162/111, 117, 206, 203, 359.1, 361, 362; 34/623

[56] References Cited

U.S. PATENT DOCUMENTS

| | | | |
|---|---|---|---|
| 4,196,045 | 4/1980 | Ogden | 162/117 |
| 5,851,353 | 12/1998 | Fiscus et al. | 162/113 |

*Primary Examiner*—Peter Chin
*Attorney, Agent, or Firm*—Patricia A. Charlier

[57] ABSTRACT

A method for can drying wet webs for tissue products to preserve web bulk includes, in one embodiment, restraining a partially dewatered wet web between a pair of sheet molding fabrics. The restrained wet web is processed over a plurality of can dryers to dry the wet web, for example from a consistency of at least about 40 percent to a consistency of at least about 70 percent. The sheet molding fabrics in this embodiment protect the wet web from direct contact with the can dryers and impart an impression in the web. A can drying assembly and tissue machine for accomplishing the method are also disclosed.

11 Claims, 4 Drawing Sheets

METHOD AND APPARATUS FOR WET WEB MOLDING AND DRYING

This application is a divisional of application Ser. No. 08/837,501 entitled Method And Apparatus For Wet Web Molding And Drying and filed in the U.S. Patent and Trademark Office on Apr. 14, 1997 now U.S. Pat. No. 5,851,353, which claims priority from application Ser. No. 60/035,271 entitled Method And Apparatus For Wet Web Molding And Drying and filed in the U.S. Patent and Trademark Office on Dec. 18, 1996. The entirety of application Ser. No. 08/837,501 is hereby incorporated by reference.

BACKGROUND OF THE INVENTION

The present invention relates generally to methods and apparatuses for making tissue products. More particularly, the invention relates to methods and apparatuses for drying wet webs with can dryers in a manner that maintains web bulk.

Bulk is an important property of tissue products such as facial and bath tissue, napkins and paper towels. The bulk of a tissue contributes to the actual and perceived softness and absorbency of the tissue.

While a great deal of effort has been directed toward machine configurations and processes for building bulk into a wet web, a significant portion of that bulk is subsequently removed from the wet web when it is dried to its final dryness. This appears to be particularly the case with can dryers. In a conventional can drying apparatus, the wet web is held between a dryer felt or dryer fabric and the surface of each can dryer.

The effect of such a conventional can drying apparatus can be to significantly decrease the bulk of the web. The repeated pressing, releasing and pressing of the wet web against the can dryers can function to iron the web. In a conventional afterdryer section utilizing can dryers, for example, it is believed that the bulk of a wet web can be decreased by as much as one-third or more from the creping blade to the reel. As a consequence, the actual and perceived softness and absorbency of the web is reduced.

Therefore, what is lacking and needed in the art is an improved can drying process that does not iron a significant amount of bulk out of the wet web when it is being dried. A related can drying apparatus to achieve this result is also needed.

SUMMARY OF THE INVENTION

It has now been discovered that an improved web can be made in a tissue machine by sandwiching the wet web between a pair of sheet molding fabrics through at least a portion of the can dryer assembly of the tissue machine. The wet web is protected from directly contacting the can dryers by the sheet molding fabrics, and because of the contact with the sheet molding fabrics, the wet web is imparted with an impression of the sheet molding fabrics. This is in contrast with prior efforts to design dryer fabrics that supported the sheet against the dryer for optimum drying conditions and did not mark the sheet.

Hence, in one embodiment, a method of making a tissue sheet comprises the steps of depositing an aqueous suspension of papermaking fibers onto an endless forming fabric to form a wet web; partially dewatering the wet web; restraining the partially dewatered wet web between a pair of sheet molding fabrics; and processing the restrained wet web over a plurality of can dryers to dry the wet web from a consistency of at least about 40 percent to a consistency of at least about 70 percent.

The present method and apparatus are particularly beneficial when utilized after the creping doctor and prior to the winding reel. Thus, in one embodiment, a method of making a tissue sheet includes the steps of depositing an aqueous suspension of papermaking fibers onto an endless forming fabric to form a wet web; transferring the wet web to an air and liquid permeable perforated belt arranged to form an endless loop; positioning the wet web on the surface of a cylindrical drying device; removing the wet web from the cylindrical drying device using a creping blade while the wet web has a consistency of at least about 40 percent; restraining the creped wet web between a pair of sheet molding fabrics; and processing the restrained wet web over a plurality of can dryers to dry the wet web to a consistency of at least about 70 percent.

Contact between the wet web and the sheet molding fabrics adds bulk to the wet web and impresses the desired repeating pattern on both sides of the wet web. The visual markings may be perceived by consumers as more cloth-like or pleasing, and therefore give the tissue an added benefit.

Additionally, by sandwiching the wet web between two sheet molding fabrics, the wet web does not directly contact the can dryer surfaces. The existing bulk in the wet web, imparted by creping or other techniques, is not ironed out of the web by repeatedly being pressed in direct contact with the drying cans. In some instances, however, it may be desirable to maintain and/or build less bulk into the web in favor of improved drying efficiency. Thus, in one alternative embodiment, a method of making a tissue sheet includes the steps of depositing an aqueous suspension of papermaking fibers onto an endless forming fabric to form a wet web; transferring the wet web to an air and liquid permeable perforated belt arranged to form an endless loop; positioning the wet web on the surface of a cylindrical drying device; removing the wet web from the cylindrical drying device using a creping blade while the wet web has a consistency of at least about 40 percent; transferring the creped wet web to a sheet molding fabric; and processing the wet web while disposed on the sheet molding fabric through a plurality of can to dryers to dry the wet web to a consistency of at least about 70 percent.

The present method may also improve the cross direction stretch of the resulting tissue. The tissue would then be more durable and flexible than would otherwise be possible at the same tensile level, which means that the tissue can be embossed harder before fracturing. Further, by molding the wet web and reducing compacting of the wet web during can drying, the absorbent capacity of the web should also increase.

The fiber consistency of the wet web should be sufficiently low while in contact with the sheet molding fabric or fabrics to permit impressioning by the fabric. In particular embodiments, the wet web enters the impressioning section of the can drying assembly with a consistency of at least about 40 percent, such as from about 40 to about 80 percent. More particularly, the wet web enters the impressioning section of the can drying assembly with a consistency of at least about 45 percent, for instance from about 45 to about 65 percent, and more particularly from about 50 to about 60 percent, for improved performance. These consistencies are particularly suited for bath tissue, facial tissue, napkins and toweling may be different for other paper grades. The terms "consistency" and "fiber consistency" are used interchangeably herein to refer to the weight percent fiber in an aqueous fiber suspension, a stock layer, or a dewatered or dried web.

Once a sufficiently high fiber consistency is obtained, the wet web may be released from contact with the sheet molding fabric or from position between the sheet molding fabrics for further drying. In a particular embodiment, for example, the can drying assembly includes a final drying section downstream of the impressioning section. It is believed to be advantageous, for instance, to release the wet web from contact with the sheet molding fabric or from position between the sheet molding fabrics upon exiting the impressioning section when the wet web reaches a consistency of at least about 70 percent, and more particularly at least about 75 percent, such as from about 75 to about 85 percent, and even more particularly from about 80 to about 85 percent, for improved pattern definition, bulk and efficiency. Drying the wet web after being released from between the sheet molding fabrics at the stated consistencies is not believed to significantly detract from the web bulk.

In another aspect of the invention, a can drying assembly for processing a wet web comprises a plurality of can dryers including a first can dryer and a last can dryer. A pair of sheet molding fabrics are each arranged to form an endless loop, and fabric handling means cause a portion of each endless loop to be united in a common run from the first can dryer to the last can dryer.

In one particular embodiment, a machine for manufacturing tissue products comprises a forming fabric adapted to form an endless loop and a means for depositing an aqueous suspension of papermaking fibers onto the forming fabric to form a wet web. An air and liquid permeable perforated belt of the machine is arranged to form an endless loop. The machine also includes means for transferring the wet web from the forming fabric to the perforated belt, a cylindrical drying device, and means for directing the wet web from the perforated belt into operable relation with the cylindrical drying device. A can drying assembly of the machine comprises an impressioning section having a plurality of can dryers and a pair of sheet molding fabrics that each form an endless loop. The sheet molding fabrics are disposed adjacent one another and form a common run over a portion of each endless loop. The common run is operatively associated with the plurality of can dryers. The machine also includes means for transferring the wet web from the cylindrical drying device to the impressioning section, such that the wet web is sandwiched between the sheet molding fabrics.

As used herein, the term "cylindrical drying device" refers to rotating drums for drying wet webs and includes throughdryers, Yankee dryers, and can dryers. The terms "throughdryer" and "throughdrying" are used herein to refer to rotating drums having heated air passing through the drum surface and through the wet web to remove moisture and dry the web. The term "Yankee dryer" is used herein to refer to a rotating, solid surface, drum wherein the wet web is adhered to the surface and removed therefrom by creping or the like. Yankee dryers are usually heated to remove moisture and dry the web, although they can be unheated and used exclusively for creping. The terms "can dryers," "can drying" and "drying cans" are used herein to refer to rotating, solid surface heated drums wherein the wet web is not adhered to the drum surface such that is must be removed by creping or comparable techniques.

The sheet molding fabrics used in the impressioning section of the can drying assembly are constructed to maintain web bulk and/or impart bulk to the web. Thus, the sheet molding fabrics suitably include, without limitation, those papermaking fabrics that exhibit significant open area or three dimensional surface contour or depressions sufficient to impart a significant degree of z-directional impressioning of the web. Such fabrics include single-layer, multi-layer, or composite permeable structures. Preferred fabrics have at least some of the following characteristics: (1) On the side of the sheet molding fabric that is in contact with the wet web (the outer side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the outer side, the distance between the highest point of the MD knuckle and the highest point of the CD knuckle is from about 0.001 to about 0.02 or 0.03 inch. In between these two levels, there can be knuckles formed either by MD or CD strands that give the topography a three-dimensional characteristic and which may be impressioned in the web during can drying; (3) On the outer side, the length of the MD knuckles is equal to or longer than the length of the CD knuckles; (4) If the fabric is made in a multi-layer construction, it is preferred that the bottom layer is of a finer mesh than the top layer so as to control the depth of web penetration; and (5) The fabric may be made to show certain geometric patterns that are pleasing to the eye, which typically repeat between every 2 to 50 warp yarns.

Specific suitable sheet molding fabrics include, by way of example, those made by Appleton Mills, Appleton, Wis. and designated as numbers P57, P116 and T 124-10. Particular sheet molding fabrics that may be used also include the fabrics disclosed in U.S. Pat. No. 5,429,686 issued Jul. 4, 1995, to Chiu et al., which is incorporated herein by reference.

The forming process and tackle can be conventional as is well known in the papermaking industry. Such formation processes include Fourdrinier, roof formers (such as suction breast roll), gap formers (such as twin wire formers, crescent formers), or the like. Forming wires or fabrics can also be conventional, with the finer weaves with greater fiber support being preferred. Headboxes used to deposit the fibers onto the forming fabric can be adapted to form layered or nonlayered webs.

The method disclosed herein can be applied to any tissue web, which includes webs for making facial tissue, bath tissue, paper towels, napkins, or the like. Such tissue webs can be single-ply products or multi-ply products, such as two-ply, three-ply, four-ply or greater. One-ply products are advantageous because of their lower cost of manufacture, while multiply products are preferred by many consumers. For multi-ply products it is not necessary that all plies of the product be the same, provided at least one ply is in accordance with this invention. The webs can be layered or unlayered (blended), and the fibers making up the web can be any fibers suitable for papermaking.

Suitable basis weights for these tissue webs can be from about 5 to about 70 grams per square meter (gsm), preferably from about 10 to about 50 gsm, and more preferably from about 30 to about 50 gsm. For a single-ply towel, a basis weight of about 40 gsm is preferred. For a single-ply bath tissue, a basis weight of about 25 gsm is preferred. For a two-ply tissue, a basis weight of about 20 gsm per ply is preferred. For a three-ply tissue, a basis weight of about 15 gsm per ply is preferred.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION OF THE INVENTION

The invention will now be described in greater detail with reference to the Figures. Unless otherwise indicated, conventional papermaking apparatus and operations can be used with respect to the headbox, forming fabrics, web transfers, drying and creping, all of which will be readily understood by those skilled in the papermaking art. Nevertheless, various conventional components are illustrated for purposes of providing the context in which the various embodiments of the invention can be used.

Figure 1:
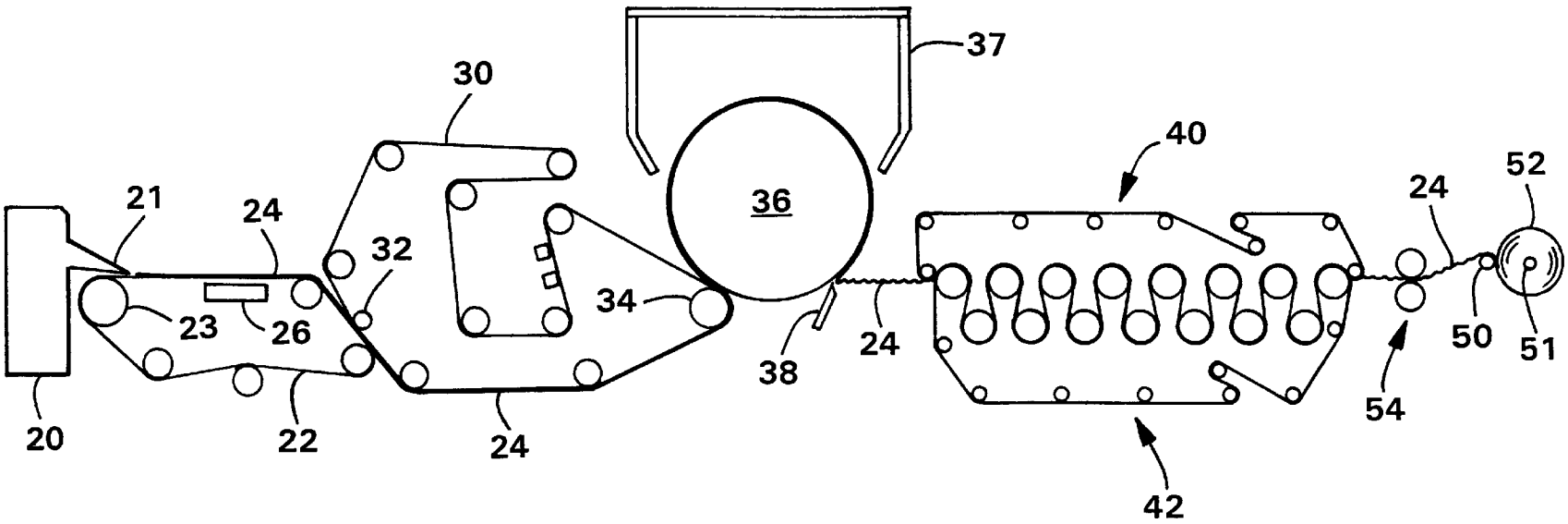
FIG. 1 is a schematic flow diagram of a tissue making apparatus used to practice a method of the present invention.

One embodiment of a method and apparatus for manufacturing a tissue is representatively shown in FIG. 1. For simplicity, the various tensioning rolls schematically used to define the several fabric runs are shown but not numbered. A papermaking headbox 20 injects or deposits an aqueous suspension of papermaking fibers 21 onto an endless forming fabric 22 traveling about a vacuum breast roll 23. The forming fabric 22 allows partial dewatering of a newly-formed wet web 24 to a consistency of about 10 percent.

While supported on the forming fabric 22, the wet web 24 may be dewatered further by one or more optional vacuum or suction boxes 26. The consistency of the wet web 24 immediately downstream of the optional dewatering boxes 26 may be from about 10 to about 30 percent. The Fourdrinier former illustrated is particularly useful for making heavier basis weight sheets useful as wipers and towels, although other forming devices such as twin wire formers, crescent formers or the like can be used instead. Hydroneedling, for example as disclosed in U.S. Pat. No. 5,137,600 issued Aug. 11, 1992 to Barnes et al., can optionally be employed to increase the bulk of the web.

The wet web 24 is then transferred from the forming fabric 22 to an air and liquid permeable perforated belt 30 that is arranged to form an endless loop. A pickup device 32, for example a vacuum pickup roll, a transfer shoe or the like, is generally employed to transfer the wet web 24 to the perforated belt 30. Alternatively, the negative pressure pickup device 32 can be supplemented or replaced by the use of a positive pressure device (not shown) on the opposite side of the wet web 24 to blow the web onto the perforated belt 30. The perforated belt 30 may be traveling at the same speed as the forming fabric 22, or a slower speed if desired.

The perforated belt 30 may comprise a conventional papermaking felt or a transfer fabric. Suitable fabrics or felts are available from Appleton Mills and are identified as AMFLEX 25.

In the illustrated embodiment, a press roll 34 is disposed within the endless loop of the perforated belt 30 and functions to press the wet web 24 onto the surface of a Yankee dryer 36. A drying hood 37 may be used in conjunction with the Yankee dryer 36. Mechanically pressing the wet web between the perforated belt 30 and the dryer surface squeezes some of the water from the wet web and adheres the web to the dryer surface. The wet web 24 is removed from the dryer surface with a creping blade 38. Creping adhesives, release agents or the like, which are well known in the art, may be applied to the surface of the Yankee dryer 36 following the creping doctor to improve dryer operation.

In one embodiment, the consistency of the wet web 24 as it approaches the press roll 34 is from about 8 to about 35 percent. Following the press roll 34, the consistency of the web is from about 30 to about 50 percent. The Yankee dryer steam pressure and hood drying capability are desirably controlled so that the consistency of the wet web 24 immediately after being removed from the Yankee dryer is at least about 40 percent, and particularly from about 50 to about 60 percent.

The wet web 24 is subsequently transferred to a can drying assembly 40 specifically configured to maintain or increase the bulk of the web and to remove moisture and dry the web. The can drying assembly 40 is shown in greater detail in FIG. 2, where components similar to those previously described have been given the same reference numeral. The illustrated can drying assembly 40 comprises an impressioning section 42 having a plurality of can dryers 44 and a pair of sheet molding fabrics 46 and 48. The exact number of can dryers 44 may vary depending on the desired increase in dryness of the wet web 24, machine speed, basis weight, and similar factors. In one particular embodiment, the impressioning section 42 could include 15 can dryers operating at 100 pounds per square inch (psi).

Each of the sheet molding fabrics 46 and 48 forms an endless loop. The various fabric handling rolls are configured so that the sheet molding fabrics 46 and 48 are disposed adjacent one another over a portion of their endless loops, thus defining a common fabric run 49 that is operatively associated with the can dryers 44. As illustrated, the common fabric run 49 follows a serpentine path over all of the can dryers 44 of the impressioning section 42. The can drying assembly 40 may include other drying devices or fabric runs (see FIG. 3) in addition to those of the impressioning section 42.

Figure 2:
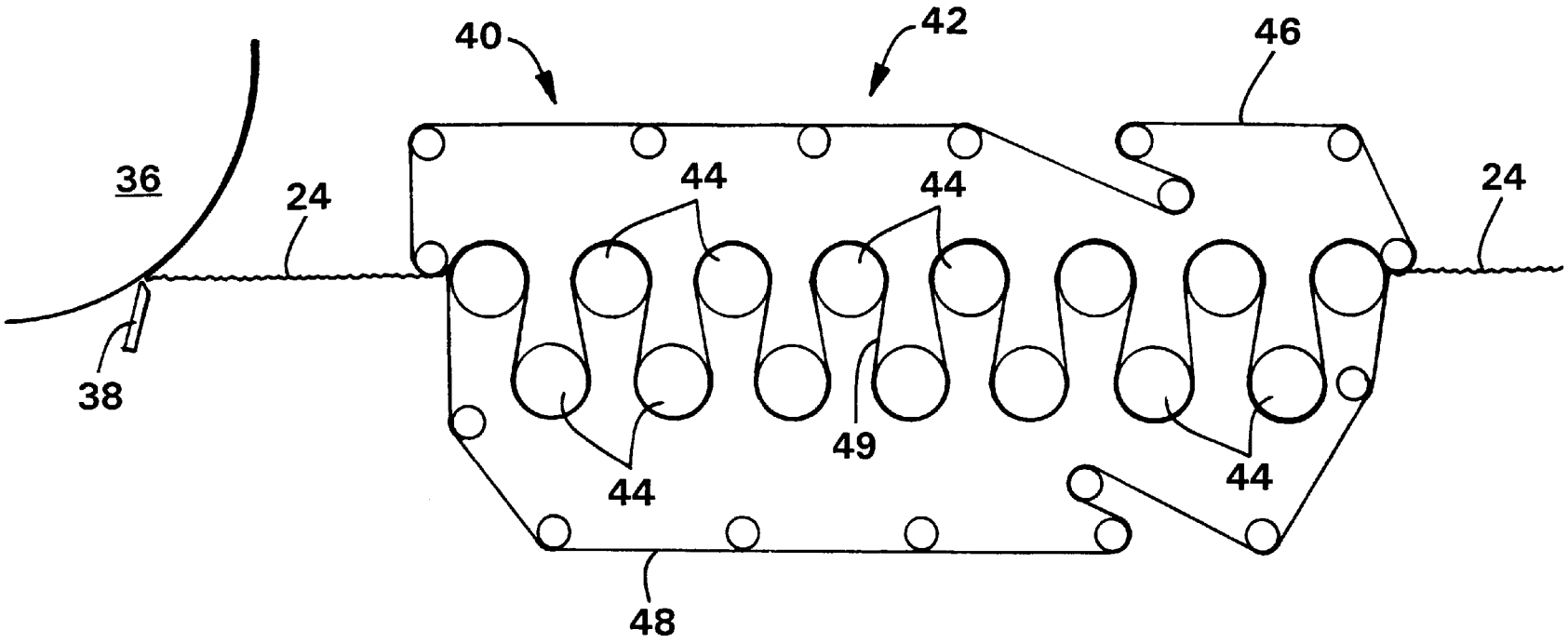
FIG. 2 representatively shows an isolated view of an after dryer section of the tissue making apparatus of FIG. 1.

The wet web 24 is transported across an open draw from the creping doctor 38 to the impressioning section 42 and is then sandwiched between the sheet molding fabrics 46 and 48. The wet web 24 remains restrained between the fabrics 46 and 48 from the first can dryer 44 through the last can dryer 44 of the impressioning section. Thus, one of the sheet molding fabrics 46 or 48 is disposed between the wet web 24 and each of the can dryers 44. In the embodiment of FIGS. 1 and 2, the wet web 24 is final dried to a consistency of about 94 percent or greater in the impressioning section 42 and is thereafter transported to a reel 50 and a reel spool 51 where the dried wet web 24 is wound into a roll 52 for subsequent conversion into the final product form. Prior to being wound onto the reel spool 51, the dried wet web 24 can be carried through one or more optional fixed gap embossing or calendering nips 54.

To retain and/or build the bulk of the wet web 24, the web desirably enters the impressioning section 42 of the can drying assembly 40 with a consistency of at least about 40 percent, such as from about 40 to about 80 percent. More particularly, the wet web enters the impressioning section 42 with a consistency of at least about 45 percent, for instance from about 45 to about 65 percent, and more particularly from about 50 to about 60 percent, for improved performance.

The wet web 24 may exit the impressioning section 42 sufficiently dry, for example greater than about 94 percent consistency, for winding onto the reel spool 51. Alternatively, the wet web 24 may exit the impressioning section 42 and be released from between the sheet molding fabrics 46 and 48 with a consistency of at least about 70 percent, at which point further noncompressive drying methods may be employed without significantly decreasing the existing bulk of the web. In particular embodiments, though, the wet web 24 desirably exits the impressioning section 42 with a consistency of at least about 75 percent, such as from about 75 to about 85 percent, and more specifically from about 80 to about 85 percent, for improved pattern definition, bulk and performance. At lower consistencies the desired repeating pattern will still be impressed upon the web, but web bulk may not be maintained through the final drying section. Under such circumstances, the wet web 24 may undergo additional drying beyond the impressioning section 42 prior to winding. Other suitable noncompressive drying methods which tends to preserve the bulk or thickness of the wet web include, without limitation, throughdrying, infra-red irradiation, microwave drying, or the like.

Figure 3:
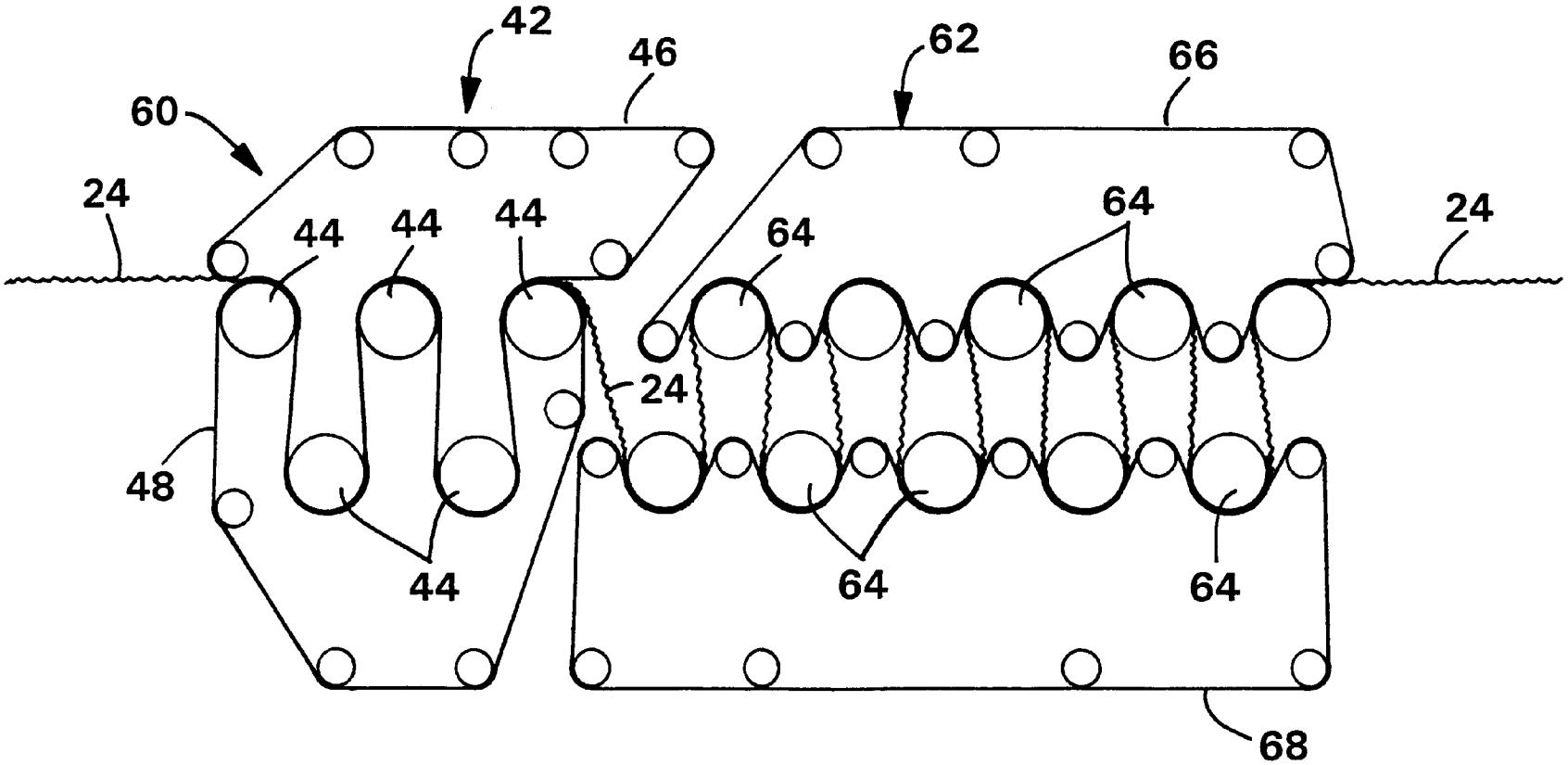
FIG. 3 representatively shows a view similar to FIG. 2 but illustrating an alternative after dryer section.

An alternative can drying assembly 60 for use with the tissue manufacturing process of FIG. 1 is illustrated in FIG. 3. Again, components similar to those previously described have been given the same reference numeral for purposes of consistency and simplicity. The can drying assembly 60 comprises an impressioning section 42 and a final drying section 62. The impressioning section 42 is similar to that described in relation to FIGS. 1 and 2 except that the number of can dryers 44 has been reduced. In one particular embodiment, the impressioning section 42 includes 5 can dryers 44 operating at 100 psi.

The wet web 24 is restrained between the pair of sheet molding fabrics 46 and 48 through the impressioning section 42, but is desirably released from between the sheet molding fabrics prior to the final drying section 62. The consistency of the wet web 24 when exiting the impressioning section 42 is desirably at least about 70 percent, and more particularly at least about 75 percent, such as from about 75 to about 85 percent or from about 80 to about 85 percent, for improved performance.

The final drying section 62 functions to remove moisture and dry the web to its final dryness. The final drying section 62 comprises a plurality of can dryers 64 and a pair of dryer fabrics or felts 66 and 68. The exact number of can dryers 64 in the final drying section 62 may vary depending on the incoming dryness, the desired final dryness, the size and operating parameters of the can dryers, and similar factors. By way of illustration, the final drying section 62 may include 10 can dryers 64 operating at 80 psi.

Each of the dryer fabrics or felts 66 and 68 forms an endless loop and is arranged to transport the wet web 24 through a serpentine path over the can dryers 64 of the final drying section 62. As illustrated in FIG. 3, the lower dryer fabric 68 guides the wet web 24 over the first can dryer 64 of the final drying section 62 and every second can dryer 64 thereafter. Correspondingly, the upper dryer fabric 66 guides the wet web 24 over the second can dryer 64 of the final drying section 62 and every second can dryer 64 thereafter. The fabrics 66 and 68 of the final drying section 62 need not form a common fabric run to sandwich the web therebetween, as was the case in the impressioning section 42. The can drying assembly 60 may include alternative or additional drying devices or fabric runs besides the final drying section 62 (not shown).

Figure 4:
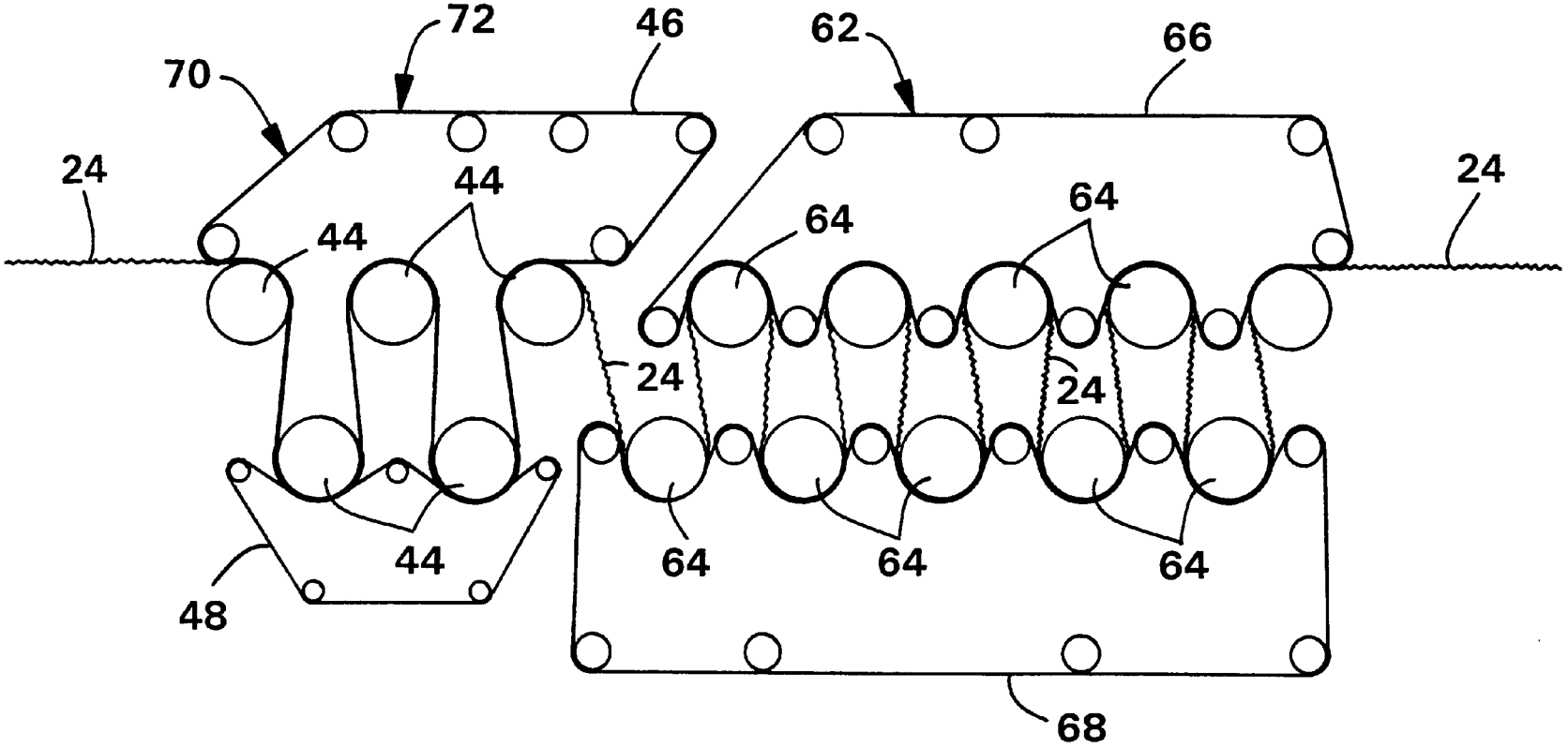
FIG. 4 representatively shows an isolated view of another alternative after dryer section.

A further alternative can drying assembly 70 for use with the tissue manufacturing process of FIG. 1 is illustrated in FIG. 4. The can drying assembly 70 may be particularly useful in instances when it is desirable to maintain and/or build less bulk into the web in favor of improved drying efficiency. The can drying assembly 70 comprises an impressioning section 72 and a final drying section 62. The impressioning section 72 comprises a plurality of can dryers 64 and a single sheet molding fabric 46. The final drying section 62 may be identical to the final drying section 62 described in relation to FIG. 3.

In this embodiment, the wet web 24 is transferred from the creping blade 38 to the sheet molding fabric 46 while the wet web has a consistency of at least about 40 percent. At this point, the wet web 24 is processed through all of the can dryers 44 of the impressioning section 72 while disposed on the single sheet molding fabric 46. Fabric 48 is used to assist in web control, particularly when threading the web through the impressioning section. Fabric 48 can be a conventional dryer fabric, or optionally an impressioning fabric. The wet web 24 and the sheet molding fabric 46 alternate being disposed directly in contact with the can dryers 44 in the impressioning section 72. The wet web 24 is thereafter removed from the sheet molding fabric 46 and transferred to the final drying section 62.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Therefore, the invention should not be limited by the specific embodiments described, but only by the claims.

We claim:

1. A can drying assembly for processing a wet web comprising:

a) a plurality of can dryers including a first can dryer, a last can dryer and several can dryers arranged therebetween;

b) a pair of sheet molding fabrics each arranged to form an endless loop, each of said pair of sheet molding fabrics passing over said first can dryer, over each of said several can dryers and then over said last can dryer in a serpentine path; and c) fabric handling means for causing a portion of each of said endless loops to be united in a common fabric run that is operatively associated with each of said plurality of can dryers starting from said first can dryer and continuing pass said last can dryer.

2. A machine for manufacturing tissue products, comprising:

a) a forming fabric adapted to form an endless loop;

b) means for depositing an aqueous suspension of papermaking fibers onto said forming fabric to form a wet web;

c) an air and liquid permeable perforated belt arranged to form an endless loop;

d) means for transferring said wet web from said forming fabric to said perforated belt;

e) a drying cylinder;

f) means for directing said wet web from said perforated belt into operable relation with said drying cylinder;

g) a can drying assembly having an impressioning section with a plurality of can dryers including a first can dryer, a last can dryer and several can dryers arranged therebetween, and a pair of sheet molding fabrics each arranged to form an endless loop, each of said pair of sheet molding fabrics passing over said first can dryer, over each of said several can dryers and then over said last can dryer in a serpentine path, said pair of sheet molding fabrics disposed adjacent to one another and forming a common fabric run over a portion of each of said endless loops, said common fabric run being operatively associated with said plurality of can dryers; and h) means for transferring said wet web from said drying cylinder to said impressioning section such that said wet web is sandwiched between said pair of sheet molding fabrics.

3. The machine of claim 2 wherein said can drying assembly further includes a final drying section having a plurality of can dryers, said wet web being released from between said pair of sheet molding fabrics prior to said final drying section.

4. A can drying assembly for processing a wet web, said wet web having a consistency of from between about 40 percent to about 80 percent, said assembly comprising:

a) a plurality of can dryers including a first can dryer, a last can dryer and several can dryers arranged therebetween; and b) a pair of sheet molding fabrics each arranged to form an endless loop, each of said pair of sheet molding fabrics passing over a portion of said first can dryer, over a portion of each of said several can dryers and then over a portion of said last can dryer in a serpentine path, and said endless loops being united in a common fabric run that is operatively associated with each of said plurality of can dryers starting from said first can dryer and continuing pass said last can dryer.

5. The can drying assembly of claim 4 wherein said wet web is restrained between said pair of sheet molding fabrics from said first can dryer to said last can dryer.

6. The can drying assembly of claim 4 wherein said pair of sheet molding fabrics are united in a common fabric run with said wet web restrained therebetween from said first can dryer to said last can dryer.

7. The can drying assembly of claim 4 wherein said wet web is introduced to said first can dryer after being creped off a dryer surface by a creping blade.

8. The can drying assembly of claim 4 wherein a Yankee dryer is positioned upstream of said first can dryer.

9. The can drying assembly of claim 4 wherein a reel spool is positioned downstream of said last can dryer.

10. The can drying assembly of claim 4 wherein said common fabric run follows a serpentine path through said plurality of can dryers.

11. The can drying assembly of claim 4 wherein said can drying assembly further includes a final drying section having a plurality of can dryers, said wet web being released from between said pair of sheet molding fabrics prior to said final drying section.

* * * * *